United States Patent [19]

Matsumura et al.

[11] Patent Number: 4,728,033

[45] Date of Patent: Mar. 1, 1988

[54] CLEANING METHOD UPON COLOR-CHANGE IN AN ELECTROSTATIC MULTI-COLOR COATING APPARATUS

[75] Inventors: Teruaki Matsumura, Nagoya; Noriyasu Suzuki, Toyoda; Michitaka Moritani, Toyoda; Hirotsugu Takaba, Toyoda, all of Japan

[73] Assignee: Trinity Industrial Corporation, Tokyo, Japan

[21] Appl. No.: 826,864

[22] Filed: Feb. 6, 1986

[51] Int. Cl.[4] ..... B05B 15/04

[52] U.S. Cl. ..... 239/1; 239/112

[58] Field of Search ..... 239/112, 113, 106, 119, 239/305, 1, 3, 8

[56] References Cited

U.S. PATENT DOCUMENTS

| | | | |
|---|---|---|---|
| 3,017,115 | 1/1962 | Artman et al. | 239/119 X |
| 4,232,055 | 11/1980 | Shaffer | 239/3 X |
| 4,403,736 | 9/1983 | Scharfenberger | 239/112 |

*Primary Examiner*—Andres Kashnikow

*Attorney, Agent, or Firm*—Cushman, Darby & Cushman

[57] ABSTRACT

Cleaning method upon color-change in an electrostatic multi-color coating apparatus adapted to supply paints of a multiplicity of colors, a cleaning air and a cleaning thinner selectively from a color-change device by way of a paint supply channel and a paint hose to an electrostatic multi-color coating machine, comprises successively steps of supplying a cleaning air and a cleaning thinner to the paint supply channel and cleaning the inside thereof by removing to discharge the paint remaining in the paint supply channel to a liquid discharge tank, sucking the paint remaining in the electrostatic coating machine and in the paint hose connected at one end thereof to the electrostatic coating machine from the other end of the paint hose and discharging the paint thus sucked to the liquid discharge tank, and then supplying a cleaning thinner and a cleaning air to the paint hose and the electrostatic coating machine to clean the inside thereof.

1 Claim, 2 Drawing Figures

CLEANING METHOD UPON COLOR-CHANGE IN AN ELECTROSTATIC MULTI-COLOR COATING APPARATUS

BACKGROUND OF THE INVENTION

1. Field of the Invention

This invention concerns a cleaning method upon color-change in an electrostatic multi-color coating apparatus in which paints of a multiplicity of colors are selectively supplied under color-change to an electrostatic coating machine having an atomizing cup applied with a high voltage and rotationally driven at a high speed.

2. Description of the Prior Art

It has been desired in the electrostatic multi-color coating apparatus of this type to reduce the cleaning time required for color-change as short as possible.

In view of the above, cleaning air and cleaning thinner are alternately supplied at high pressure to a paint supply channel connected between an electrostatic coating machine and a color-change device, so that the inside of the color supply channel and the atomizing cup of the electrostatic coating machine can be cleaned rapidly.

In this method, however, since the cleaning air and the cleaning thinner are supplied at a great flow rate in a short time to the inside of the paint supply channel, paint and paint-containing thinner are instantaneously discharged in a great amount from the atomizing cup of the electrostatic coating machine, which overflow from a discharged liquid recovering shroud disposed around the periphery of the atomizing cup of the electrostatic coating machine and are scatter around to contaminate peripheral equipments or the coating machine main body.

OBJECT OF THE MACHINE

It is, accordingly, an object of this invention to provide a cleaning method upon color-change in an electrostatic multi-color coating apparatus for cleaning a paint supply channel and a paint hose when supplying a paint selected from a color-change device to the electrostatic coating machine while preventing the paint from scattering out of the atomizing cup of the coating machine, by discharging a paint remaining in the paint supply channel using a cleaning air and a cleaning thinner supplied from the color-change device into a liquid discharge tank and sucking to remove the paint remaining in the paint hose connected at one end thereof to the coating machine from the other end thereof by means of an ejector.

SUMMARY OF THE INVENTION

The foregoing object of this invention can be attained by a cleaning method upon color-change in an electrostatic multi-color coating apparatus adapted to supply paints of a multiplicity of colors, a cleaning air and a cleaning thinner selectively from a color-change device by way of a paint supply channel and a paint hose to an electrostatic multi-color coating machine, which method comprises successively steps of supplying a cleaning air and a cleaning thinner to the paint supply channel and cleaning the inside thereof by removing to discharge the paint remaining in the paint supply channel to a liquid discharge tank, a second step of sucking the paint remaining in the electrostatic coating machine and in the paint hose connected at one end thereof to the coating machine from the other end of the hose and discharging the paint thus sucked to the liquid discharge tank, and then a third step of supplying a cleaning thinner and a cleaning air to the paint hose and the electrostatic coating machine to clean the inside thereof.

In accordance with this invention, the paint remaining in the paint supply channel connected to the color-change device is discharged into the liquid discharge tank by the cleaning air and the cleaning thinner supplied from the color-change device, while the paint remaining in the electrostatic coating machine and in the paint hose connected thereto are sucked by an ejector and discharged into the liquid discharge tank and, thereafter, the cleaning thinner and the cleaning air are supplied to the paint hose for cleaning the inside thereof. Thus, since the paint remaining in the paint supply channel and the paint hose is not discharged as usual by being blowing out of the electrostatic coating machine, the trouble experienced so far that the paint discharged from the electrostatic coating machine is scattered around to contaminate the peripheral equipments and the coating machine main body.

BRIEF DESCRIPTION OF THE DRAWINGS

These and other objects, features, as well as advantageous effects of this invention will now be described more in details by way of its preferred embodiment while referring to the drawings, wherein.

PREFERRED EMBODIMENT

Figure 1:
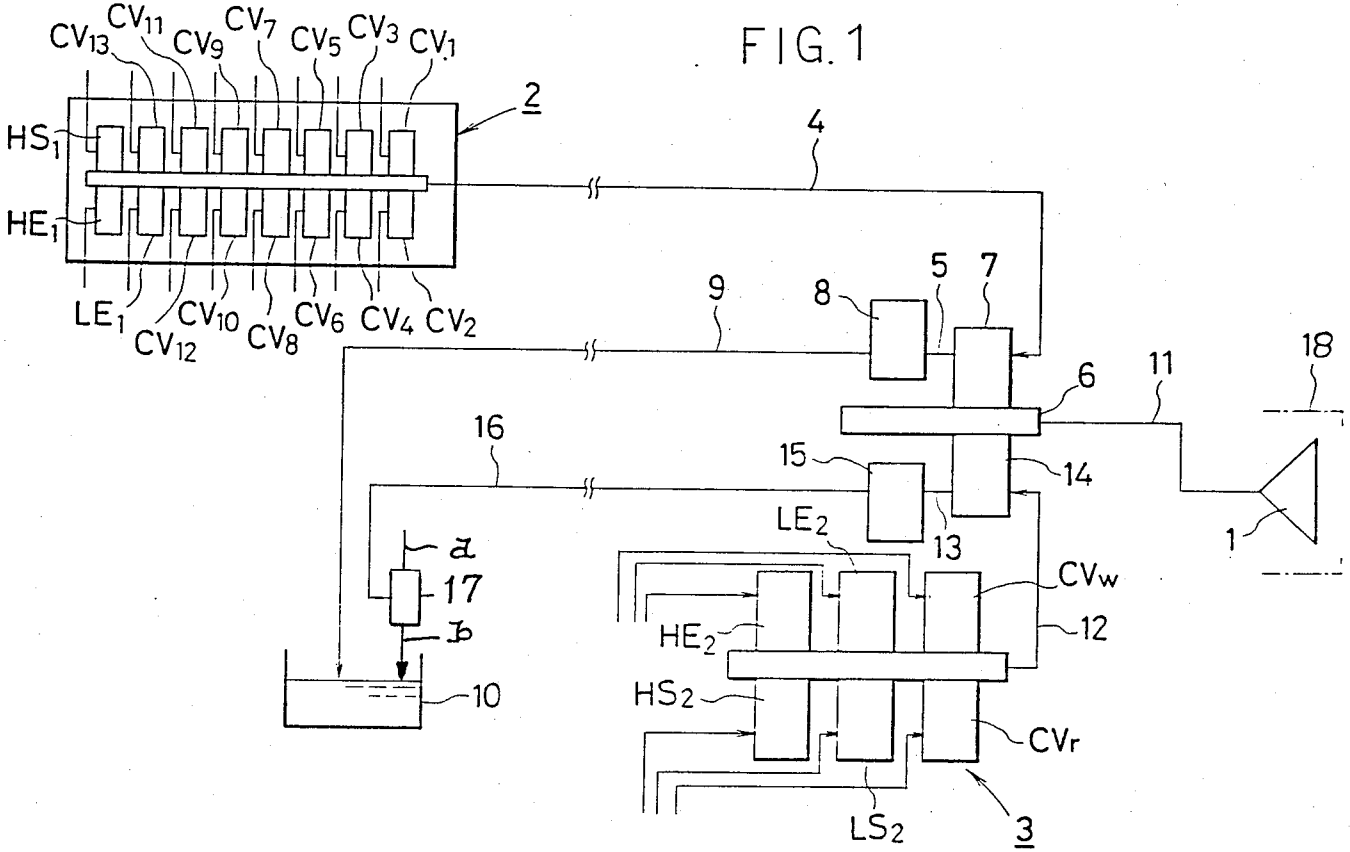
FIG. 1 is a system chart showing the schematic constitution for one embodiment of an electrostatic multi-color coating apparatus to which the method according to this invention is applied.

FIG. 1 is a system chart showing the schematic constitution of an electrostatic coating apparatus for automobiles used in this invention.

CONSTITUTION OF THE EMBODIMENT

In the drawings, there are shown an atomizing cup or bell 1 of an electrostatic coating machine which is applied with a high voltage and rotationally driven at a high speed, a first color-change device 2 supplied with paints of a multiplicity of colors from a plurality of paint supply sources (not illustrated), cleaning air and cleaning thinner and a second color-change device 3 which is smaller in size than the first color-change device 2 and disposed near the atomizing cup (or, simply, cup) 1 of the electrostatic coating machine, and supplied with paints of at least one color, cleaning airs at high and low pressures and cleaning thinners at high and low pressure.

A first paint supply channel 4 is extended over a relatively long distance from the first color-change device 2 toward the cup 1 of the electrostatic coating machine and connected to a first switching valve 7, which is disposed near the cup 1 and has 2-way exit channels 5 and 6 for supplying a paint of a desired color selected from the color-change device 2 to the cup 1.

The switching valve 7 is connected at one exit channel 5 thereof by way of a liquid discharging ON-OFF valve 8 to a liquid discharge channel 9, which is further connected to a liquid discharge tank 10, while the other exit channel 6 is connected by way of a shorter paint hose 11 to the cup 1.

A second paint supply channel 12 much shorter than the first paint supply channel 4 is disposed for supplying a paint selected by the second color-change device 3 to the cup 1 of the electrostatic coating machine, and the channel 12 is connected to a second switching valve 14, which is disposed near the cup 1 and has 2-way exit channels 13 and 6.

The switching valve 14 is disposed between the first switching valve 7 and the paint hose 11, in which the exit channel 13 on one side is connected by way of a liquid discharging ON-OFF valve 15 to a liquid discharge channel 16 and the exit channel 6 on the other side is used in common with the exit channel 6 of the first switching valve 7 and connected by way of the paint hose 11 to the cup 1. The liquid discharge channel 16 from the ON-OFF valve 15 is connected to the liquid discharge tank 10 by way of an ejector 17. The ejector is a device usually called a jet pump or an ejector adapted to jet fluid at high speed and high pressure to cause a low pressure area to which low pressure fluid is connected and sucked in and discharged hydrodynamically with the jet. The ejector 17 has a port a for introducing a high pressure air stream for sucking liquid paint from the channel 16 by the sudden drop of pressure near the high speed air stream and a discharge port b for discharging the resulting air-paint mixture to the liquid dischrage tank 10.

The first color-change device 2 comprises a plurality of color-change valves CV1–CV13 connected to paint supply sources of different colors (not illustrated) respectively, a low pressure air supply valve LE1, a high pressure air supply valve HE1 and a high pressure thinner supply valve HS1.

The second color-change device 3 comprises a color change valve CVw supplied with a paint, for example, of white paint and a color-change valve CVr supplied with a paint, for example, of red color both of which are used frequently, a low pressure air supply valve LE2 and a high pressure air supply valve HE2, as well as a low pressure thinner supply valve LS2 and a high pressure thinner supply valve HS2.

A shroud 18 is disposed retractably to the cup 1.

OPERATION OF THE EMBODIMENT

Figure 2:
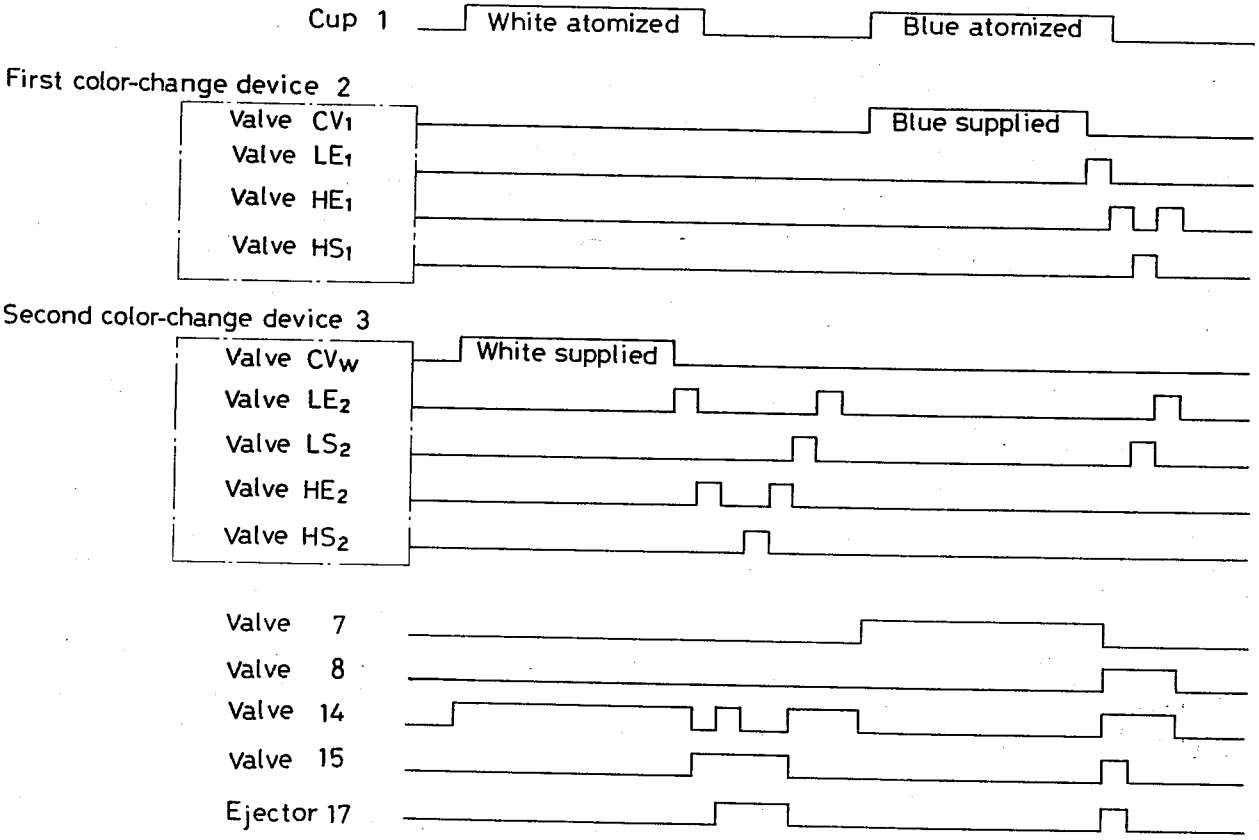
FIG. 2 is a time chart for illustrating one embodiment of the method according to this invention.

The schematic constitution of the electrostatic coating apparatus for use in automobiles has been described in conjuction with FIG. 1. The method of this invention using such an illustrated apparatus will now be described specifically also referring to the time chart shown in FIG. 2.

Assuming for instance, such a case where a white paint and a red paint most frequently used as the colors for a car body are supplied respectively to the color-change valves CVw and CVr of the second color-change device 3 disposed near the cup 1 of the electrostatic coating machine and an automobile of white color (not illustrated) is conveyed into a painting region, a high voltage is at first applied to the cup 1 and, at the same time, it is rotationally driven at a high speed.

Then, the second switching valve 14 is opened while the first switching valve 7 is being closed, to thereby establish a flow path from the second color-change device 3 by way of the second paint supply channel 12 and the paint hose 11 to the cup 1. Subsequently, the color-change valve CVw disposed to the second color change device 3 is opened to supply a white paint through the thus formed flow path.

Coating is thus started, and the white paint is released from the cup 1 under electrostatic atomization and coated electrostatically to the surface of the car body being conveyed.

Then, the color-change valve CVw is closed just before the completion of the coating and, at the same time, the low pressure air supply valve LE2 is opened to supply a cleaning air at low pressure about at the same level as that of the white paint having been supplied from the color-change valve CVw to the inside of the second paint supply channel 12.

In this way, the white paint is electrtostatically atomized from the cup 1 continuously till the completion of the coating, so that non-painted areas are not left on the car body, as well as most of the paint which would otherwise remain in the flow path is discharged under electrostatic atomization and can be used effectively with no loss.

When the coating has thus been completed, the low pressure air supply valve LE2 is closed and, at the same time, the number of rotations for the cup 1 is reduced and the shroud 18 retractably disposed near the cup 1 is advanced so as to surround the cup 1. Then, after closing the second switching valve 14 and opening the liquid discharging ON-OFF valve 15, the high pressure air supply valve HE2 disposed to the second color-change device 3 is intermittently opened to discharge the white paint still remaining in the second paint supply channel 12 by way of the liquid discharge channel 16 to the liquid discharge tank 10.

Then, the second switching valve 14 is opened in this state and the ejector 17 is actuated to suck the paint remaining in the paint hose 11 and discharge the paint by way of the liquid discharge channel 16 to the inside of the liquid discharge tank 10. In this case, a small amount of the cleaning thinner may preferably be supplied from the low pressure thinner supply valve LS2 disposed to the second color-change device 3 to the paint hose 11 to dilute the residual paint in the paint hose before the actuation of the ejector 17. This can much facilitate the sucking and discharging of the residual paint by the ejector 17. Then, after closing the second switching valve 14, the high pressure thinner supply valve HS2 and the high pressure air supply valve HE2 disposed to the second color-change device 3 are alternately opened and closed to clean the inside of the liquid discharge channel 16.

Subsequently, the liquid discharging ON-OFF valve 15 is closed, and the low pressure thinner supply valve LS2 and the low pressure air supply valve LE2 of the second color-change device 3 are successively opened to supply the low pressure cleaning thinner and the low pressure cleaning air by way of the second paint supply channel 12 and the paint hose 11 to the inside of the cup 1. Thus, the paint hose 11 and the cup 1 can be cleaned finely.

In this way, since only the cleaning thinner and the cleaning air under low pressure are discharged from the cup 1, there is no trouble as experienced so far that the residual paint discharged from the cup 1 is scattered to the outside of the shroud 18 to contaminate the peripheral equipments and the electrostatic coating machine main body.

In a case where color of the coating paint is changed to that of a paint, for instance, supplied to the color change-valve CV1 of the first color-change device 2 (for example, blue paint) after the cleaning has thus been completed, the second switching valve 14 is closed and the first switching valve 7 is opened to establish a flow path communicating from the first color-change device 2 by way of the first paint supply channel 4 and the paint hose 11 to the cup 1. Meanwhile, the shroud 18 is retracted from the cup 1 and the number of rotation for the cup 1 is increased to a predetermined number of rotation.

Then, the coating is started again by opening the color-change valve CV1 and supplying the blue paint supplied to the valve CV1 by way of the flow path to the cup 1 thereby applying electrostatic coating on a succeeding car body now being conveyed.

Just before the completion of the coating, the color-change valve CV1 is closed and, simultaneously, the low pressure air supply valve LE1 is opened to supply the low pressure cleaning air about at the same level as that of the paint supplied from the color-change valve CV1.

Thus, the paint in the first paint supply channel 4 is supplied to the cup 1 for electrostatic atomization continuously till the completion of the coating and, accordingly, most of the paint which would otherwise remain in the first paint supply channel 4 is electrostatically atomized from the cup 1 and can be used effectively with no loss.

When the coating has thus been completed, the low pressure air supply valve LE1 is closed and, at the same time, the number of rotation of the cup 1 is reduced and the shroud 18 is advanced so as to surround the cup 1.

Then, after closing the first switching valve 7 and opening the liquid dicharging ON-OFF valve 8, the high pressure air supply valve HE1 and the high pressure thinner supply valve H1 disposed to the first color-change device 2 are alternately opened to discharge the paint remaining in the first paint supply channel 4 by way of the liquid discharge channel 9 to the liquid discharge tank 10, by which the inside of the first paint supply channel 4 is cleaned rapidly. In addition, after closing the first switching valve 7 and opening the second switching valve 14 and the liquid discharging ON-OFF valve 15, the ejector 17 is actuated to suck the paint remaining in the paint hose 11 and discharge it by way of the liquid discharge channel 16 to the liquid discharge tank 10 as described above.

The liquid discharging ON-OFF valve 15 is then closed and the low pressure thinner supply valve L2 and the low pressure air supply valve LE2 of the second color-change device 3 are successively opened to supply cleaning thinner and the cleaning air at low pressure by way of the second paint supply channel 12 and the paint hose 11 to the inside of the cup 1. Thus, the paint hose 11 and the cup 1 are cleaned finely.

Accordingly, since only the cleaning thinner and the cleaning air are discharged at low pressure from the cup 1 also in this case, there is no worry as has been experienced so far that the residual paint is discharged from the cup 1 and scattered to the outside of the shroud 18 to contaminate the peripheral equipments and the electrostatic coating machine main body with the scattered paint.

As described above, a paint of particular color used most frequently is supplied from the second color-change device 3 disposed near the cup 1 of the electrostatic coating machine by way of an extremely short second paint supply channel 12 and the hose 11 to the cup 1, whereby the amount of the paint used can be saved.

Further, since the paint in the relatively long first paint supply channel 4 connected between the first color-change device 2 and the first switching valve 7, as well as that in the second paint supply channel 12 connected between the second color-change device 3 and the second switching valve 14 are supplied by the cleaning air at low pressure to the cup 1 just before the completion of the coating, the residual amount of the paint in the first and the second paint supply channels 4 and 12 upon completion of the coating is extremely reduced, whereby the amount of the paint discharged as the discharge liquid can be decreased to facilitate the cleaning operation as well as reduce the loss of the paint.

Furthermore and particularly, since the paint remaining in the paint hose 11 and the cup 1 was previously discharged by the ejector 17 to the liquid discharge tank 10 before the low pressure cleaning air and the low pressure cleaning thinner are supplied from the second color-change device 3 to the paint hose 11 and the cup 1 for cleaning them, there is no worry as has been experienced so far that the paint remaining in the paint hose is jetted out from the cup 1 and scattered around to the outside of the shroud 18 to contaminate the peripheral equipments and the electrostatic coating machine main body.

Although this invention has been described for the purpose of illustrated by way of its preferred embodiments shown in the appended drawings, it will be apparent to those skilled in the art not various modifications and alterations may be made without departing the spirit and scope of this invention.

What is claimed is:

1. Cleaning method upon color-change in an electrostatic multi-color coating apparatus adapted to supply paints of a multiplicity of colors, a cleaning air and a cleaning thinner selectively from a color-change device by way of a paint supply channel and a paint hose to the atomizing cup of an electrostatic multi-color coating machine, which method comprises successive steps of:

(a) changing the connection of said paint supply channel from that with said paint hose to that with a first liquid discharge channel leading to a liquid discharge tank upon completion of paint coating, (b) supplying a cleaning air and a cleaning thinner from said color-change device to said paint supply channel, thereby discharging the paint remaining in said paint supply channel to said liquid discharge tank and cleaning the inside of said paint supply channel, while (c) connecting said paint hose to a second liquid discharge channel leading to said tank, (d) sucking the paint remaining in said electrostatic coating machine and in said paint hose and discharging said paint by way of an ejector disposed in said second liquid discharge channel to said liquid discharge tank, and then (e) supplying a cleaning thinner and a cleaning air to said paint hose and said electrostatic coating machine thereby cleaning the insides thereof.

* * * * *